US006579844B1

(12) United States Patent
Morrison et al.

(10) Patent No.: US 6,579,844 B1
(45) Date of Patent: Jun. 17, 2003

(54) DETERGENT PARTICLES AND METHODS FOR MAKING THEM

(75) Inventors: Christopher Andrew Morrison, Cullercoats (BE); Scott John Donoghue, Newcastle upon Tyne (BE)

(73) Assignee: The Procter & Gamble Co., Cincinnati, OH (US)

( * ) Notice: Subject to any disclaimer, the term of this patent is extended or adjusted under 35 U.S.C. 154(b) by 27 days.

(21) Appl. No.: 09/979,528

(22) PCT Filed: Jun. 20, 2000

(86) PCT No.: PCT/US00/16920

§ 371 (c)(1), (2), (4) Date: Nov. 14, 2001

(87) PCT Pub. No.: WO00/78914

PCT Pub. Date: Dec. 28, 2000

(51) Int. Cl.[7] ..... C11D 3/06
(52) U.S. Cl. ..... 510/445; 510/444; 510/443
(58) Field of Search ..... 510/443, 438, 510/349, 392, 444, 441, 307, 393, 324

(56) References Cited

U.S. PATENT DOCUMENTS

| | | | | | |
|---|---|---|---|---|---|
| 3,931,037 | A | * | 1/1976 | Hall | 510/534 |
| 4,097,418 | A | * | 6/1978 | Rolfes | 510/534 |
| 4,721,633 | A | * | 1/1988 | Baldassin | 427/212 |

FOREIGN PATENT DOCUMENTS

| | | |
|---|---|---|
| DE | 42 43 704 A1 | 6/1994 |
| EP | 0 889 116 A1 | 1/1999 |
| GB | 2 190 921 A | 12/1987 |
| WO | WO 00/24859 | 5/2000 |

* cited by examiner

*Primary Examiner*—Gregory E. Webb
(74) *Attorney, Agent, or Firm*—Julia A. Glazer; Marianne Dressman; Kim Zerby

(57) ABSTRACT

The present invention relates to particulate detergent compositions and methods for making them. Such detergent compositions may be used for any cleaning purposes, in particular for dishwashing or laundry detergents. A combination of first and second particulate detergent components are formed into a single particle. The first and second particulate being of different colors.

19 Claims, No Drawings

DETERGENT PARTICLES AND METHODS FOR MAKING THEM

FIELD OF THE INVENTION

The present invention relates to particulate detergent compositions and methods for making them. Such detergent compositions may be used for any cleaning purposes, in particular for dish-washing or laundry detergents. They may be used directly in the form of particulate detergent compositions or alternatively, may be formed into tablets of detergent composition using any of the well known tabletting methods such as compaction.

BACKGROUND OF THE INVENTION

In order to meet the needs of the consumer, particulate detergents must meet several criteria in addition to providing good cleaning properties. Such additional criteria include: good flow properties so that they can be easily delivered from the container to the washing machine or washing process; good solubility/dispensing so that they will be delivered into the wash effectively; and in addition, particulate detergents must appeal to the consumer aesthetically. Most particulate detergents comprise a primarily white or pale-coloured base with optional colour-contrasting speckles. It has been found that detergents where the base particles vary in hue are judged by the consumer to be undesirable and are even thought by the consumer to provide less effective cleaning.

However, since detergent compositions generally comprise pre-processed detergent components such as agglomerates, blown powder produced by spray drying processes or extrudates, in addition to raw materials, and because the raw materials themselves vary so much in colour, size and/or shape, significant efforts must be made to avoid non-uniformity. In order to address this, considerable efforts and high costs are required to provide detergent particulates with uniform properties.

It would therefore be desirable to find a method for making detergents which enable use of a wider range of active detergent materials such as those with wide variations of colour, shape and/or size, yet to produce detergent particles with good flow properties and good dispensing and dissolving properties in addition to good aesthetic properties.

The present inventors have now found improved particles and methods for making such particles which overcome these problems of the prior art.

SUMMARY OF THE INVENTION

In accordance with the present invention, there is now provided a detergent particle comprising at least two particulate components, a first component of a first colour and a second component of a second colour, the first and second components being adhered to one another, the mean particle size of at least the first or second particulate component being no more than 50% of the mean particle size of the detergent particle.

In accordance with a further aspect of the present invention there is provided a detergent particle having a sphericity index no greater than 1.7 comprising at least two particulate components, a first component and a second component, at least one of the first and second components having a sphericity index greater than 1.7, the first and second components being adhered to one another substantially in the absence of pressure compaction.

In accordance with a further aspect of the present invention there is provided a detergent particle having a geometric mean particle diameter greater than 500 microns, the detergent particle comprising a first particulate component and a second particulate component, the first and second particulate components being adhered to one another substantially in the absence of pressure compaction, the geometric mean particle size of at least one of the first and second components being no more than 50% of the geometric mean particle size of the detergent particle. Preferably at least one of the first and second particulate components has a span of at least 1.7.

In accordance with the present invention, there is also provided a method for making the detergent particles described, comprising contacting the first particulate component and the second particulate component, optionally in the presence of a binder in a moderate to low shear mixing step to adhere the first and second particulate components to one another and detergent composition comprising the claimed detergent particles.

DETAILED DESCRIPTION OF THE INVENTION

The present inventors have found that by selecting a combination of first and second particulate detergent components and forming these into a single particle, the undesirable properties and lack of uniformity can be overcome. Furthermore, these benefits can be achieved without the intensive processing steps which have been used in the prior art, such as formation of particulates from pastes which require lengthy, energy intensive mixing such as high shear mechanical mixing and even extrusion, both of which use compaction pressure to form particulates and require energy intensive drying processes.

In accordance with a first aspect of the present invention, the first and second particulates are differently coloured from one another. Colour difference as used herein refers to the $\Delta E$ value as measured using tri-stimulus colorimetry using a D25M Colorimeter manufactured by Hunter Laboratories. In such a colorimeter, L, a and b values are generated for a sample by directing incident light onto a sample of powder at a 45° angle. Incident light is reflected from the sample and collected by photo detectors which are set vertically above the powder sample at 0°. The detectors convert the light intensity into tri-stimulus values (X,Y,Z) as documented by Commission Internationale de l'Eclairage (CIE). These values are then used to form a descriptive colour term on a standard CIELAB colour scale. The method is well documented, for example, in "Industrial Color Technology" by R. Johnston and M. Saltzman, American Chemical Society, 1971.

Using the CIELAB colour scale, L expresses whiteness where L=100 for white samples and L=0 for black samples; a represents red/green where positive numbers indicate redness and negative numbers indicate colours towards the green end of the spectrum; and b represents yellow/blue where positive numbers indicate yellowness and negative numbers indicate blueness.

Thus for the present invention, colour difference is a positive $\Delta E$ value between samples of the first and second particulate components where $\Delta E=\sqrt{(\Delta L^2+\Delta a^2+\Delta b^2)}$, where $\Delta L$ is the difference in L value between the first and second particulate components, $\Delta a$ is the difference in a value between the first and second particulate components and $\Delta b$ is the difference in b value between the first and second particulate components. In particular, in the invention there will generally be a ΔE value of at least 3. The invention is particularly useful for even larger colour differences such as ΔE values of at least 4, or even at least 6 or 8 or even at least 10. A further useful colour definition is whiteness which is represented by W=L-3b. A whiteness value of from 92 to 100 is preferred for the detergent particles of the invention.

As used herein, "sphericity index" refers to the mean value obtained when one measurement is taken of each of 50 particles taken from a sample of particles (either the detergent particles produced according to the invention, or the first or second partiuclates which form the detergent particles), and the value for sphericity index is calculated for each particle based on the following equation: sphericity index=$p^2/(4\pi a)$, where p is the perimeter of the particle and a is the area of the particle as measured using a Leica Q500MC image analysis system. The apparatus consists of a microscope connected to a video camera and computer. Commercially available software such as the Q500 software supplied by Leica is used to analyse the magnified images and to give values for p and a. The sphericity index of a perfect circle is 1.

Thus, in accordance with a further aspect of the invention, the sphericity index of the detergent particle is no greater than 1.7 and the sphericity index of at least one of the first and second particulate components is at least 1.7. Preferably the standard deviation of the span of the detergent particles of the invention is less than 0.8, preferably less than 0.5 and most preferably below 0.2.

The sphericity index of the detergent particles according to the invention is preferably no greater than 1.5, more preferably no greater than 1.3 or even 1.2. The sphericity index of at least one of the first and second particulates is preferably greater than 1.9 or even greater than 2.1 or even greater than 2.5. Thus, the invention enables highly irregular components to be adhered together to form a highly regular detergent particle without the need for high energy compaction pressure processing via aqueous pastes or slurries such as in extrusion or high shear mixing processes. The invention is even useful when both the first and second particulates comprise highly irregular particles, so that preferably, the sphericity index of both the first and second particulates is greater than 1.9 or even greater than 2.1 or 2.5 or even 3.

As used herein, "geometric mean particle diameter" means the geometric mass median diameter of a set of discrete particles as measured by any standard mass-based particle size measurement technique, preferably by dry sieving. A suitable sieving method is in accordance with ISO 3118 (1976). A suitable device is the Ro-Tap testign sieve shaker Model B using 8" sieves of selected sizes. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook*, pp. 6–11, Marcel Dekker 1997.

In accordance with a third aspect of the present invention, the geometric mean particle diameter of at least the detergent particle is at least 500 microns and the geometric particle diameter of at least one of the first and second particulate components is no more than 50% of the geometric mean particle diameter of the detergent particle, preferably no greater than 25% or even no greater than 10% or 5%. Preferably, the geometric mean particle diameter of both the first and second particulate components is as defined. In addition, at least one of the first and second particulate components has a span (geometric standard deviation) of at least 1.7, or even at least 2 or 2.5 or at least 3 or at least 3.5 or even at least 4 or at least 5. Preferably, the span of both the first and second particulate components is as defined. The invention is particularly useful for forming detergent particles having a span at least 0.3, preferably at least 0.4 or even at least 0.5 or greater, below the span of the first and/or second particulates. Thus, in trying to achieve highly regular detergent particles, rather than using as raw materials for the processing, highly regular materials and high energy processes, the present inventors have found that the process of the present invention enable highly irregular, less energy intensive raw materials to be used in a less energy intensive process to produce high quality, high regularity detergent particles.

The particle sizes of the first and second components can vary widely. The invention has been found to be useful even where there is a difference in geometric mean particle diameter between the first and second particulate components of at least 200 microns or even of at least 250 or 300 or even at least 400 or even at least 500 microns. Preferably one or both of the first and second particulates has a geometric mean particle diameter below 550 μm. It is particularly preferred that at least one of the first and second particulate components has a geometric mean particle diameter greater than 150 μm or even greater than 200 μm and preferably no greater than 450 μm or even no greater than 400 μm.

In one embodiment of the invention, the ratio of the mean particle sizes of the first and second particulate components respectively will be at least 3:2, preferably at least 2:1 or even a high ratio of at least 5:1 or at least 10:1. The ratio may be even higher such that the ratio is at least 20:1 or even at least 50:1. Where the ratio is high it is preferred that the relatively smaller particulate component has a colour which is most desirable relative to the colour of the other particulate component. It may also be preferred that the smaller particle diameter particulate component the smaller sphericity index.

In addition, the process of the present invention is suitable for forming detergent particles from first and second particulates each having a wide span of bulk densities and having bulk densities which vary significantly from one that of one another. As used herein the term "bulk density" refers to the uncompressed, untapped powder bulk density, as measured by pouring an excess of particulate sample through a funnel into a smooth metal vessel (e.g. a 500 ml volume cylinder) scraping off the excess off the heap above the rim of the vessel, measuring the remaining mass of powder and dividing the mass by the volume of the vessel.

The bulk density of the first and second particulate components may differ by at least 25 g/l, or even by at least 75 g/l or at least 100 g/l. The bulk density of the first and second particulate components, respectively is generally above 200 g/l and may be as high as 1500 g/l. It is particularly preferred that the bulk density of at least one particulate component will be greater than 700 g/l, preferably greater than 750 g/l or even above 800 g/l.

The bulk density of the detergent particles of the invention will generally be from 400 to 1100 g/l, generally the bulk density will be above 550 g/l, preferably greater than 650 g/l or even greater than 700 g/l. The invention may be particularly useful for preparing detergent particles having bulk density below 550 g/l , or even below 500 or below 450 g/l.

Each of the first and second particulate components may comprise an individual detergent ingredient in particulate form or may comprise a pre-formed detergent particulate. As used herein, the pre-formed particulate may comprise any combination of two or more detergent ingredients. Suitable pre-formed particulates may have been formed by a spray-dying, agglomeration, marumerisation, extrusion or compaction process, all of which methods for combining detergent ingredients are well known in the art. Particularly preferred pre-formed particulates are powders obtained from spray-drying processes, agglomerates and extrudates. Spray dried powders are particularly useful.

Suitable spray-drying processes for forming such pre-formed particulates are described for example in EP-A-763 594 or EP-A-437888. Suitable processes for forming pre-formed particulates which are agglomerates are described for example in WO93/25378, EP-A-367339, EP-A-420317 or EP-A-506184 and suitable processes for forming pre-formed particulates by extrusion are described for example in WO91/02047.

The pre-formed particulates may be in their wet or dry states for example, it is common in formation of detergent particulates that initially, the particulates are wet and undergo a drying stage. In the present invention, the pre-formed particulate may be a particulate before it has undergone a drying stage. Generally this means that a solvent used as a binding agent for the processing is present in higher amounts that are desirably present in a finished particulate detergent. Generally, such a solvent will be water and the particulates may have a water content for example 15 to 30 wt % of the pre-formed particulate. Often however, the pre-formed particulate will already have undergone a drying step prior to addition to the mixer so that the water content may be below 15 wt % or even below 10 wt %.

It is particularly preferred that any pre-formed particulate component comprises a surfactant or mixture of surfactants. Suitable surfactants are described below. The surfactant content of a pre-formed particulate component is preferably from 5 to 80% by weight of the particulate component. Amounts of surfactants above 10 or even above 30% may be preferred. Amounts of surfactant below 70% or even below 50% may be preferred. Where the pre-formed particulate component comprises surfactant, generally it will in addition comprise a builder or alkalinity agent such as sodium carbonate, zeolite, or phosphate. For example, each of these components individually, or in mixtures may be present in amounts above 5%, preferably above 10% or even above 20% by weight of the content of the pre-formed particulate component. Particularly preferred builder components are sodium carbonate and/or zeolite. Zeolite A and zeolite MAP are both suitable.

A pre-formed particulate component preferably also comprises an organic builder such as a poly carboxylic acid and/or salt such as citric acid, tartaric acid, malic acid, succinic acid and their salts or a polymeric polycarboxylate such as polymers based on acrylic acids or maleic acids or co-polymers thereof. Such components are generally present in the particle at levels below 15 wt % of the particulate component, preferably below 10 wt % of the particulate component.

Other preferred ingredients in the pre-formed particulate component are chelants such as phosphonate chelants NTA, DTPA and succinic acid derivative chelants, as described below. These components are preferably present in a pre-formed particulate component in amounts below 5 wt % or even below 2 wt % of the first particulate component. Suds suppressors and/or soil release polymers and/or bleach activators are also preferred ingredients in pre-formed particulates.

Where the particulate components are detergent raw materials, any particulate detergent ingredient is suitable. These may be solid surfactants or soaps, or water soluble or dispersable polymeric materials, enzymes, bleaching components such as bleach activators or bleach salts such as peroxy salts, but are generally inorganic components, particularly water soluble inorganic components such as builders. These ingredients are discussed in more detail below.

The detergent particles themselves may contain all of the ingredients of a full formulated detergent or may be mixed with additional detergent components such as individual detergent ingredients in particulate form or pre-formed detergent particles as described above. Preferably, detergent compositions of the present invention comprise more than 30 wt %, more preferably more than 50 wt % or even as high as 80 or 90 wt % or even at least 95 wt % of the detergent particles according to the present invention.

The processes of the invention may comprise the step of adding to the mixer a binder to facilitate production of the desired detergent particles. Generally such a binder will be liquid in the form of a solution or melt and will be added by spraying either directly into the mixer or onto the particulate components as they travel into the mixer. Preferably the binder is added directly into the mixer for example by spraying. The binder is added for purposes of enhancing agglomeration by providing a binding or sticking agent for detergent components. The binder may be any conventional detergent binding agent, preferably selected from the group consisting of water, anionic surfactants, nonionic surfactants, polyethylene glycol, polyvinyl pyrrolidone, polyacrylates, organic acids or their salts such as citric acid or citric salts, and mixtures thereof. Other suitable binder materials including those listed herein are described in Beerse et al, U.S. Pat. No. 5,108,646 (Procter and Gamble Company), the disclosure of which is incorporated herein by reference.

Thus, in one aspect of the invention, a first feed stream of first particulate component is fed into the mixer and in addition a second feed stream comprising the second particulate component is fed into the mixer and binder is also present in the mixer. The binder may be fed directly via a third stream into the mixer or it may be contacted with the first and/or second particulate component prior to one or both of these feed streams entering the mixer. Where the mixer is divided into different zones, the three components may be fed into the same zone or optionally may be fed into different zones. In a preferred embodiment of the invention, the first and second particulate components will be pre-mixed prior to addition of the binder.

In a further preferred aspect of the invention, after mixing of the first and second particulate components optionally with binder, so that adhesion of the two components has taken place, a further liquid component is applied to the outside of the particles produced. This further coating may be the same chemical composition as the binder or may be any of the other coating materials or detergent ingredients described below.

In order to provide the moderate to low shear mixing in which the first and second particulates are adhered to one another in the present invention, suitable moderate to low shear mixers may be for example a Lodige KM (trademark) (Ploughshare) moderate speed mixer, or mixer made by Fukae, Draes, Schugi or similar brand mixers which mix with only moderate to low shear. The Lodige KM (ploughshare) moderate speed mixer which is a preferred mixer for use in the present invention comprises a horizontal hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft, which preferably operate at about 3600 rpm. Other mixers similar in nature which are suitable for use in the process include the Lodige Ploughshare™ mixer and the Drais® K-T 160 mixer. Generally, in the processes of the present invention, the shear will be no greater than the shear produced by a Lodige KM mixer with the tip speed of the ploughs below 10 m/s, or even below 8m/s or even lower.

Preferably, the mean residence time of the various starting detergent ingredients in the low or moderate speed mixer is preferably in range from about 0.1 seconds to about 30 minutes, most preferably the residence time is about 0.5 to about 5 minutes. In this way, the density of the resulting detergent agglomerates is at the desired level.

Other suitable mixers for use in the present invention are low or very low shear mixers such as rotating bowl agglomerators, drum agglomerators, pan agglomerators and fluid bed agglomerators.

Fluid bed agglomerators are particularly preferred. Typical fluidised bed agglomerators are operated at a superficial air velocity of from 0.1 to 4 m/s, either under positive or negative pressure. Inlet air temperatures generally range from −10 or 5° C. up to 250° C. However inlet air temperatures are generally below 200° C., or even below 150° C. The fluidized bed granulator is preferably operated such that the flux number FN of the fluid bed is at least about 2.5 to about 4.5. Flux number ($FN_m$) is a ratio of the excess velocity ($U_e$) of the fluidisation gas and the particle density ($p_p$) relative to the mass flux ($q_{liq}$) of the liquid sprayed into the bed at a normalized distance ($D_o$) of the spraying device. The flux number provides an estimation of the operating parameters of a fluidized bed to control granulation within the bed. The flux number may be expressed either as the mass flux as determined by the following formula:

$$FN_m \log_{10}[\{P^p U_e\}/q_{liq}]$$

or as the volume flux as determined by the formula:

$$FN_v = \log_{10}[\{U_e\}/q_{vliq}]$$

where $q_{vlig}$ is the volume of spray into the fluid bed. Calculation of the flux number and a description of its usefulness is fully described in WO 98/58046 the disclosure of which is herein incorporated by reference.

In addition, the fluidized bed is generally operated at a Stokes number of less than about 1, more preferably from about 0.1 to about 0.5. The Stokes number is a measure of particle coalescence for describing the degree of mixing occurring to particles in a piece of equipment such as the fluid bed. The Stokes number is measured by the formula:

$$\text{Stokes number} = 4pvd/9u$$

wherein p is the apparent particle density, v is the excess velocity, d is the mean particle diameter and u is the viscosity of the binder. The Stokes number and a description of its usefulness is described in detail in WO 99/03964, the disclosure of which is herein incorporated by reference.

Thus, where the mixer is a fluid bed mixer, the first and second particulate components are passed into a fluid bed optionally having multiple internal "stages" or "zones". A stage or zone is any discrete area within the fluid bed, and these terms are used interchangeably herein. The process conditions within a stage may be different or similar to the other stages in the fluid bed/dryer. It is understood that two adjacent fluid beds are equivalent to a single fluid bed having multiple stages. The various feed streams of the first and second particulate components can be added at the same or different stages, depending on, for example, the particle size and moisture level of the feed stream. Feeding different streams to different stages can minimize the heat load on the fluid bed, and optimize the particle size and increase uniformity of the shape of the detergent particles produced.

The bed is typically fluidized with heated air in order to dry or partially dry moisture such as any binder liquids from the ingredients in the fluid bed. Where binder is sprayed into the fluid bed the spraying is generally achieved via nozzles capable of delivering a fine or atomized spray of the binder to achieve intimate mixing with the particulates. Typically, the droplet size from the atomizer is less than about 2 times the particle size. This atomization can be achieved either through a conventional two-fluid nozzle with atomizing air, or alternatively by means of a conventional pressure nozzle. To achieve this type of atomization, the solution or slurry rheology is may have a viscosity of less than about 500 centipoise, preferably less than about 200 centipoise at the point of atomization. While the nozzle location in the fluid bed may be in most any location, the preferred location is a positioning that allows a vertical down spray of any liquid components such as binder. This may be achieved for example, using a top spray configuration. To achieve best results, the nozzle location is placed at or above the fluidized height of the particles in the fluid bed. The fluidized height is typically determined by a weir or overflow gate height. The agglomeration/granulation zone of the fluid bed may be followed by an optional coating zone, followed by a drying zone and a cooling zone. Of course, one of ordinary skill in the art will recognize that alternative arrangements are also possible to achieve the resultant particles of the present invention.

Typical conditions within a fluid bed apparatus of the present invention include: (i) a mean residence time from about 1 to about 20 minutes, (ii) a depth of unfluidised bed of from about 100 to about 600 mm, (iii) a droplet spray size of less than 2 times the mean particle size in the bed, which is preferably not more than about 100 micron more preferably not more than 50 micron, (iv) spray height generally from 150 to 1600 mm of spray height from the fluid bed plate or preferably 0 to 600 mm from the top of the fluid bed, (v) from about 0.1 to about 4.0 m/s, preferably 1.0 to 3.0 m/s of fluidizing velocity and (vi) from about 12 to about 200° C. of bed temperature, preferably 15 to 100° C. Once again, one of ordinary skill in the art will recognize that the conditions in the fluid bed may vary depending on a number of factors.

The detergent particles produced in the mixer can be further processed by adding a coating agent to improve the particle colour, increase the particle whiteness or improve the particle flowability after the detergent particles exit the mixer or the dryer if an optional drying step is added subsequently to the mixer or in a later stage in the mixer, to obtain the high density granular detergent compositions produced by the processes of the invention. Those skilled in the art will appreciate that a wide variety of methods may be used to dry as well as cool the exiting detergent without departing from the scope of the invention. Since the mixer can be operated at relatively low temperatures, the need for cooling apparatus is generally not required in the present process which thereby further reduces manufacturing costs of the final product.

Another optional processing step includes continuously adding a coating agent such as zeolite and/or fumed silica to the mixer to facilitate free flowability of the resulting detergent particles and to prevent over agglomeration. Such coating agents generally have a mean particle size below 100 microns, preferably below 60 microns, even more preferably below 50 microns.

Any coating stage may take place either immediately after formation of the detergent particles of the invention either before or after any drying step and optionally after the detergent particles have been mixed with additional detergent ingredients for forming a fully formulated detergent composition. Preferably any such coating agent will also have detergent active properties. A particularly preferred coating agent is a surfactant or aqueous solution of surfactant.

The detergent particles produced according to the present invention preferably have a geometric mean particle diameter of at least 500 microns or at least 600 or even at least 700 microns. Generally the mean particle diameter will be no greater than 3000 microns, preferably no greater than 2500 or even no greater than 1500 microns. The sphericity index of the detergent particles according to the present invention will preferably be no greater than 1.5 or even no greater than 1.4 or 1.3 or even no greater than 1.2. The span of the detergent particles according to the invention is generally from 1 to 1.8, preferably no greater than 1.7, most preferably no greater than 1.6 or even 1.4.

The weight percentage of the detergent particles derived from the first and second particulate components respectively may be in a ratio of from 100:1 to 1:100. Where the geometric mean particle diameter of a desirably coloured particulate component is no more than 10% or even no more than 5% of the geometric mean particle diameter of an undesirably coloured particulate the weight ratio will be low, but the number average of particles of the desirably coloured component in the detergent particle will generally be at least 50, preferably at least 100 or even 500 or 1000 times the number average of the undesirably coloured component in the detergent particle.

Detergent ingredients which are suitable as ingredients of the first particulate component or the second particulate component and/or as ingredients of any additional ingredients added to the detergent particles of the present invention to form the fully formulated detergent compositions of the invention, are described below.

Detergent Ingredients Surfactant

Suitable surfactants for use in the invention are anionic, nonionic, ampholytic, and zwitterionic classes of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Preferably, the detergent particle of the present invention and compositions comprising such particles comprises an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

The anionic surfactants may be present in the detergent particle in amounts below 25 wt % or even below 20 wt % but in a final detergent composition comprising the particle, is preferably present at a level of from 0.1% to 60%, more preferably from 1 to 40%, most preferably from 5% to 30% by weight.

Other anionic surfactants include the anionic carboxylate surfactants such as alkyl ethoxy carboxylates, alkyl polyethoxy polycarboxylates and soaps ("alkyl carboxyls") such as water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors. Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Other anionic surfactants include isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein). Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates. Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

Preferred surfactant combinations are mixtures of the preferred alkyl sulfate and/or sulfonate and alkyl ethoxysulfate surfactants optionally with cationic surfactant. Such mixtures have been disclosed in PCT Patent Application No. WO 93/18124.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Essentially any alkoxylated nonionic surfactant or mixture is suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are particularly suitable for use herein. Particularly preferred are the condensation products of straight or branched, primary or secondary alcohols having an alkyl group containing from 6 to 22 carbon atoms with from 2 to 10 moles of ethylene oxide per mole of alcohol.

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable $C_1$–$C_4$ alkyl; and $R_2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units. Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Suitable amphoteric surfactants for use herein include the amine oxide surfactants and the alkyl amphocarboxylic acids. Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10}$–$C_{18}$ acylamido alkyl dimethylamine oxide.

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaines such as $C_{12\text{-}18}$ dimethyl-ammonio hexanoate and the $C_{10\text{-}18}$ acylamidopropane (or ethane) dimethyl (or diethyl) betaines and sultaine surfactants are exemplary zwitterionic surfactants for use herein.

Suitable cationic surfactants to be used herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Cationic ester surfactants such as choline ester surfactants, have for example been disclosed in U.S. Pat. Nos. 4,228,042, 4,239,660 and 4,260,529 are also suitable as are cationic mono-alkoxylated amine surfactants preferably of the general formula I:

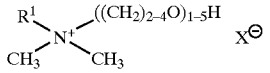

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

The levels of the cationic mono-alkoxylated amine surfactants in the detergent compositions of the invention are generally from 0.1% to 20%, preferably from 0.2% to 7%, most preferably from 0.3% to 3.0% by weight.

Cationic bis-alkoxylated amine surfactant such as

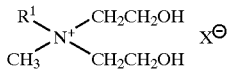

are also useful, wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride.

Bleach Activator

The detergent particles or detergent compositions containing them preferably comprise a bleach activator, preferably comprising an organic peroxyacid bleach precursor. It may be preferred that the composition comprises at least two peroxy acid bleach precursors, preferably at least one hydrophobic peroxyacid bleach precursor and at least one hydrophilic peroxy acid bleach precursor, as defined herein. The production of the organic peroxyacid occurs then by an in situ reaction of the precursor with a source of hydrogen peroxide. The bleach activator may alternatively, or in addition comprise a preformed peroxy acid bleach.

It is preferred that the bleach activator is present in the detergent particle. It may be preferred that the bleach activator is present as a separate, admixed particle.

Preferably, at least one of the bleach activators, preferably a peroxy acid bleach precursor, is present in a particulate component having an average particle size, by weight, of from 600 microns to 1400 microns, preferably from 700 microns to 1100 microns. More preferably, all of the activator are present in one or more particulate components having the specified weight average particle size.

Hereby, it may be preferred that at least 80%, preferably at least 90% or even at least 95% or even substantially 100% of the component or components comprising the bleach activator have a particle size of from 300 microns to 1700 microns, preferably from 425 microns to 1400 microns.

Preferred hydrophobic peroxy acid bleach precursor preferably comprise a compound having an oxy-benzene sulphonate group, preferably NOBS, DOBS, LOBS and/ or NACA-OBS. Preferred hydrophilic peroxy acid bleach precursors preferably comprises TAED.

Peroxyacid Bleach Precursor

Peroxyacid bleach precursors are compounds which react with hydrogen peroxide in a perhydrolysis reaction to pro duce a peroxyacid. Generally peroxyacid bleach precursors may be represented as

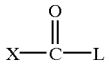

where L is a leaving group and X is essentially any functionality, such that on perhydroloysis the structure of the peroxyacid produced is

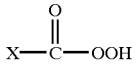

For the purpose of the invention, hydrophobic peroxyacid bleach precursors produce a peroxy acid of the formula above wherein X is a group comprising at least 6 carbon atoms and a hydrophilic peroxyacid bleach precursor produces a peroxyacid bleach of the formula above wherein X is a group comprising 1 to 5 carbon atoms.

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition. Preferred L groups are selected from the group consisting of

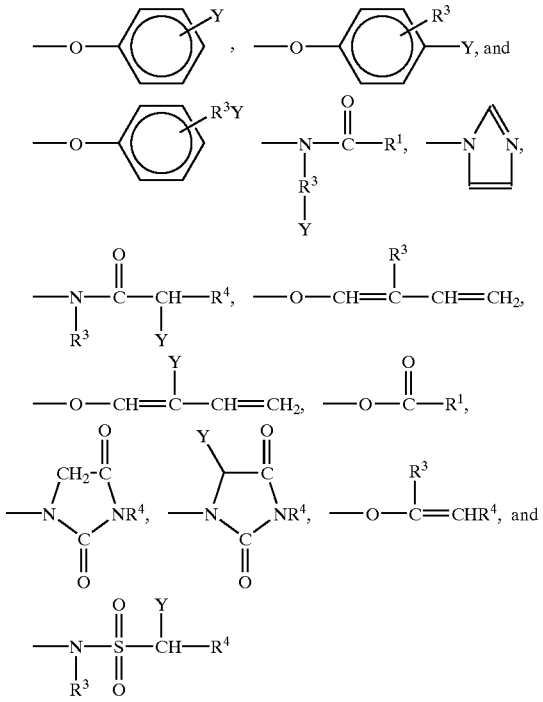

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alky, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Peroxyacid bleach precursor compounds are preferably incorporated in final detergent compositions at a level of from 0.5% to 30% by weight, more preferably from 1% to 15% by weight, most preferably from 1.5% to 10% by weight. The ratio of hydrophilic to hydrophobic bleach precursors, when present, is preferably from 10:1 to 1:10, more preferably from 5:1 to 1:5 or even from 3:1 to 1:3. Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Alkyl percarboxylic acid bleach precursors form percarboxylic acids on perhydrolysis. Preferred precursors of this type provide peracetic acid on perhydrolysis. Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred as hydrophilic peroxy acid bleach precursor. Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide substituted alkyl peroxyacid precursor compounds are suitable herein, including those of the following general formulae:

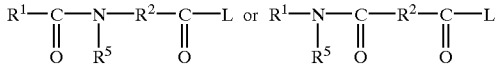

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386. It can be preferred that $R^1$ and $R^5$ forms together with the nitrogen and carbon atom a ring structure.

Preferred examples of bleach precursors of this type include amide substituted peroxyacid precursor compounds selected from (6-octanamido-caproyl)oxybenzenesulfonate, (6-decanamido-caproyl) oxybenzene-sulfonate, and the highly preferred (6-nonanamidocaproyl)oxy benzene sulfonate, and mixtures thereof as described in EP-A-0170386.

Perbenzoic acid precursor compounds which provide perbenzoic acid on perhydrolysis benzoxazin organic peroxyacid precursors, as disclosed for example in EP-A-332294 and EP-A-482807 and cationic peroxyacid precursor compounds which produce cationic peroxyacids on perhydrolysis are also suitable.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650, 08/298904 and 08/298906.

Suitable cationic peroxyacid precursors include any of the anmuonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

The particles or compositions of the present invention may contain, in addition to, or as an alternative to, an organic peroxyacid bleach precursor compound, a preformed organic peroxyacid, typically at a level of from 0.1% to 15% by weight, more preferably from 1% to 10% by weight.

A preferred class of organic peroxyacid compounds are the amide substituted compounds as described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Peroxide Source

Inorganic perhydrate salts are a preferred source of peroxide. Preferably these salts are present at a level of from 0.01% to 50% by weight, more preferably of from 0.5% to 30% by weight of the composition or component.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

Chelants

As used herein, chelants refers to detergent ingredients which act to sequester (chelate) heavy metal ions. These components may also have calcium and magnesium chelation capacity, but preferentially they show selectivity to binding heavy metal ions such as iron, manganese and copper.

Chelants are generally present in the detergent particle or final detergent composition at a level of from 0.005% to 10%, preferably from 0.1% to 5%, more preferably from 0.25% to 7.5% and most preferably from 0.3% to 2% by weight of the compositions or component Suitable chelants include organic phosphonates, such as the amino alkylene poly (alkylene phosphonates), alkali metal ethane 1-hydroxy disphosphonates and nitrilo trimethylene phosphonates, preferably, diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable chelants for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof, and iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable. EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable. Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof. In particular the chelating agents comprising a amino or amine group can be bleach-sensitive and are suitable in the compositions of the invention.

Water-Soluble Builder Compound

The component or compositions herein preferably contain a water-soluble builder compound, typically present in detergent compositions at a level of from 1% to 80% by weight, preferably from 10% to 60% by weight, most preferably from 15% to 40% by weight.

The detergent compositions of the invention preferably comprise phosphate-containing builder material. Preferably present at a level of from 0.5% to 60%, more preferably from 5% to 50%, more preferably from 8% to 40%.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No.1, 387,447. The most preferred polycarboxylic acid containing three carboxy groups is citric acid, preferably present at a level of from 0.1% to 15%, more preferably from 0.5% to 8% by weight.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398, 421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Partially Soluble or Insoluble Builder Compound

The component in accord with the present invention or the compositions herein may contain a partially soluble or insoluble builder compound, typically present in detergent compositions at a level of from 0.5% to 60% by weight, preferably from 5% to 50% by weight, most preferably from 8% to 40% weight.

Examples of largely water insoluble builders include the sodium aluminosilicates. As mentioned above, it may be preferred in one embodiment of the invention, that only small amounts of alumino silicate builder are present.

Suitable aluminosilicate zeolites have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].xH_2O$$

wherein x is from 20 to 30, especially 27. Zeolite X has the formula $Na_{86}$ $[(AlO_2)_{86}(SiO_2)_{106}].276$ $H_2O$.

Another preferred aluminosilicate zeolite is zeolite MAP builder. The zeolite MAP can be present at a level of from 1% to 80%, more preferably from 15% to 40% by weight.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a median particle size $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer, described herein. Other methods of establishing $d_{50}$ values are disclosed in EP 384070A.

Other Deterrent Ingredients

A preferred ingredients of the compositions herein are dyes and dyed particles or speckles, which can be bleach-sensitive. The dye as used herein can be a dye stuff or an aqueous or nonaqueous solution of a dye stuff. It may be preferred that the dye is an aqueous solution comprising a dyestuff, at any level to obtain suitable dyeing of the detergent particles or speckles, preferably such that levels of dye solution are obtained up to 2% by weight of the dyed particle, or more preferably up to 0.5% by weight, as described above. The dye may also be mixed with a non-aqueous carrier material, such as non-aquous liquid materials including nonionic surfactants.

Optionally, the dye also comprising other ingredients such as organic binder materials, which may also be a non-aqueous liquid.

The dyestuff can be any suitable dyestuff. Specific examples of suitable dyestuffs include E104—food yellow 13 (quinoline yellow), E110—food yellow 3 (sunset yellow FCF), E131—food blue 5 (patent blue V), Ultra Marine blue (trade name), E133—food blue 2 (brilliant blue FCF), E140—natural green 3 (chlorophyll and chlorphyllins), E141 and Pigment green 7 (chlorinated Cu phthalocyanine). Preferred dyestuffs may be Monastral Blue BV paste (trade name) and/or Pigmasol Green (trade name).

Another preferred ingredient of the particles or compositions of the invention is a perfume or perfume composition. Any perfume composition can be used herein. The perfumes may also be encapsulated. Preferred perfumes containing at least one component with a low molecular weight volatile component, e.g. having a molecular weight of from 150 to 450 or preferably 350. Preferably, the perfume component comprises an oxygen-containing functional group. Preferred functional groups are aldehyde, ketone, alcohol or ether functional groups or mixtures thereof.

Another highly preferred ingredient useful in the particles or compositions herein is one or more additional enzymes. Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in WO95/26397 and WO96/23873. Amylase enzyme may be incorporated into the composition in accordance with the invention at a level of from 0.0001% to 2% active enzyme by weight. Lipolytic enzyme may be present at levels of active lipolytic enzyme of from 0.0001% to 2% by weight, preferably 0.001% to 1% by weight, most preferably from 0.001% to 0.5% by weight. The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S. Bagsvaerd, Denmark, under the trade name Lipolase. This lipase is also described in U.S. Pat. No. 4,810,414, Huge-Jensen et al, issued Mar. 7, 1989.

The component or compositions herein also preferably contain from about 0.005% to 5% by weight of certain types of hydrophilic optical brighteners, as mentioned above.

Examples are Tinopal-JNPA-GX™ and Tinopal-CBS-X™ by Ciba-Geigy Corporation. Others include Tinopal 5BM-GX™, Tinopal-DMS-X™ and Tinopal AMS-GX™ by Ciba Geigy Corporation.

Photo-Bleaching Agent

Photo-bleaching agents are preferred ingredients of the compositions or components herein. Preferred photo-bleaching agent herein comprise a compounds having a porphin or porphyrin structure. Porphin and porphyrin, in the literature, are used as synonyms, but conventionally porphin stands for the simplest porphyrin without any substituents; wherein porphyrin is a sub-class of porphin. The references to porphin in this application will include porphyrin. The porphin structures preferably comprise a metal element or cation, preferably Ca, Mg, P, Ti, Cr, Zr, In, Sn or Hf, more preferably Ge, Si or Ga, or more preferably Al , most preferably Zn. It can be preferred that the photo-bleaching compound or component is substituted with substituents selected from alkyl groups such as methyl, ethyl, propyl, t-butyl group and aromatic ring systems such as pyridyl, pyridyl-N-oxide, phenyl, naphthyl and anthracyl moieties.

The photo-bleaching compound or component can have solubilizing groups as substituents. Alternatively, or in addition hereto the photo-bleaching agent can comprise a polymeric component capable of solubilizing the photo-bleaching compound, for example PVP, PVNP, PVI or co-polymers thereof or mixtures thereof.

Highly preferred photo-bleaching compounds are compounds having a phthalocyanine structure, which preferably have the metal elements or cations described above.

The phthalocyanines can be substituted for example the phthalocyanine structures which are substituted at one or more of the 1–4, 6, 8–11, 13, 15–18, 20, 22–25, 27 atom positions.

Organic Polymeric Ingredients

Organic polymeric compounds are preferred additional herein and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quatemised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions or component.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoamines and diamines of the formula:

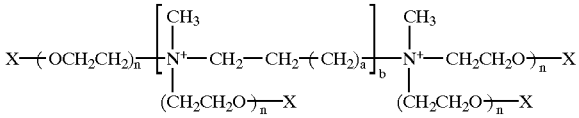

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The components and detergent compositions herein, when formulated for use in machine washing compositions, may comprise a suds suppressing system present at a level of from 0.01% to 15%, preferably from 0.02% to 10%, most preferably from 0.05% to 3% by weight of the composition or component.

Suitable suds suppressing systems for use herein may comprise essentially any known antifoam compound, including, for example silicone antifoam compounds and 2-alkyl alcanol antifoam compounds or soap.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof as described in U.S. Pat. No. 2,954,347, issued Sep. 27, 1960 to Wayne St. John.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises antifoam compound, preferably comprising in combination polydimethyl siloxane, at a level of from 50% to 99%, preferably 75% to 95% by weight of the silicone antifoam compound; and silica, at a level of from 1% to 50%, preferably 5% to 25% by weight of the silicone/silica antifoam compound wherein said silica/silicone antifoam compound is incorporated at a level of from 5% to 50%, preferably 10% to 40% by weight a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10% such as DCO544, commercially available from DOW Corning, and an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight.

A highly preferred particulate suds suppressing system is described in EP-A-0210731. EP-A-0210721 discloses other preferred particulate suds suppressing systems.

Other highly preferred suds suppressing systems comprise polydimethylsiloxane or mixtures of silicone, such as polydimethylsiloxane, aluminosilicate and polycarboxylic polymers, such as copolymers of laic and acrylic acid. Polymeric dye transfer inhibiting agents when present are generally in amounts from 0.01% to 10%, preferably from 0.05% to 0.5% and are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Polymeric soil release agents, hereinafter "SRA", can optionally be employed in the present components or compositions. If utilized, SRAs will generally be used in amounts from 0.01% to 10.0%, typically from 0.1% to 5%, preferably from 0.2% to 3.0% by weight. Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRAs are for example as described in U.S. Pat. No. 4,968,451, Nov. 6, 1990 to J. J. Scheibel and E. P.

Gosselink. Other SRAs include the nonionic end-capped 1,2-propylene/polyoxyethylene terephthalate polyesters of U.S. Pat. No. 4,711,730, Dec. 8, 1987 to Gosselink et al. Other examples of SRA's include: the partly- and fully-anionic-end-capped oligomeric esters of U.S. Pat. No. 4,721,580, Jan. 26, 1988 to Gosselink; the nonionic-capped block polyester oligomeric compounds of U.S. Pat. No. 4,702,857, Oct. 27, 1987 to Gosselink; and the anionic, especially sulfoaroyl, end-capped terephthalate esters of U.S. Pat. No. 4,877,896, Oct. 31, 1989 to Maldonado, Gosselink et al. SRAs also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagalcu Kogyo KK.

Additional classes of SRAs include those described in U.S. Pat. No. 4,201,824, Violland et al. and U.S. Pat. No. 4,240,918 Lagasse et al.; U.S. Pat. No. 4,525,524 Tung et al., and U.S. Pat. No. 4,201,824, Violland et al.

Other optional ingredients suitable for inclusion in the compositions of the invention include colours and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

The detergent compositions can include as an additional component a chlorine-based bleach. However, since the detergent compositions of the invention are solid, most liquid chlorine-based bleaching will not be suitable for these detergent compositions and only granular or powder chlorine-based bleaches will be suitable. Alternatively, a chlorine based bleach can be added to the detergent composition by the user at the beginning or during the washing process. The chlorine-based bleach is such that a hypochlorite species is formed in aqueous solution. The hypochlorite ion is chemically represented by the formula $OCl^-$.

Those bleaching agents which yield a hypochlorite species in aqueous solution include alkali metal and alkaline earth metal hypochlorites, hypochlorite addition products, chloramines, chlorimines, chloramides, and chlorimides. Specific examples include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine-based bleach can be Triclosan (trade name).

Most of the above-described hypochlorite-yielding bleaching agents are available in solid or concentrated form and are dissolved in water during preparation of the compositions of the instant invention. Some of the above materials are available as aqueous solutions.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 litres, as are typical product dosages and wash solution volumes commonly employed in conventional machine laundry methods. Preferred washing machines may be the so-called low-fill machines.

In a preferred use aspect the composition is formulated such that it is suitable for hard-surface cleaning or hand washing. In another preferred aspect the detergent composition is a pre-treatment or soaking composition, to be used to pre-treat or soak soiled and stained fabrics.

EXAMPLES

The following examples are presented for illustrative purposes only and are not to be construed as limiting the scope of the appended claims in any way.

Abbreviations Used in the Examples

In the detergent compositions, the abbreviated component identifications have the following meanings:

| | |
|---|---|
| LAS | Sodium linear C11–13 alkyl benzene sulfonate |
| TAS | Sodium tallow alkyl sulfate |
| CxyAS | Sodium C1x–C1y alkyl sulfate |
| Branched AS | branched sodium alkyl sulfate as described in WO99/19454 |
| C46SAS | Sodium C14–C16 secondary (2,3) alkyl sulfate |
| CxyEzS | Sodium C1x–C1y alkyl sulfate condensed with z moles of ethylene oxide |
| CxyEz | C1x–C1y predominantly linear primary alcohol condensed with an average of z moles of ethylene oxide |
| QAS | R2.N + (CH3)2(C2H4OH) with R2 = C12–C14 |
| QAS 1 | R2.N + (CH3)2(C2H4OH) with R2 = C8–C11 |
| APA | C8–C10 amido propyl dimethyl amine |

-continued

| | |
|---|---|
| Soap | Sodium linear alkyl carboxylate derived from an 80/20 mixture of tallow and coconut fatty acids |
| STS | Sodium toluene sulphonate |
| CFAA | C12–C14 (coco) aklyl N-methyl glucamide |
| TFAA | C16–C18 alkyl N-methyl glucamide |
| TPKFA | C12–C14 topped whole cut fatty acids |
| STPP | Anhydrous sodium tripolyphosphate |
| TSPP | Tetrasodium pyrophosphate |
| Zeolite A | Hydrated sodium aluminosilicate of formula Na12(AlO2SiO2)12.27H2O having a primary particle size in the range from 0.1 to 10 micrometers (weight expressed on an anhydrous basis) |
| NaSKS-6 | Crystalline layered silicate of formula d- Na2Si2O5 |
| Citric acid | Anhydrous citric acid |
| Borate | Sodium borate |
| Carbonate | Anydrous sodium carbonate: particle size 200 μm to 900 μm |
| Bicarbonate | Anhydrous sodium bicarbonate with a particle size distribution between 400 μm and 1200 μm |
| Silicate | Amorphous sodium silicate (SiO2:Na2O = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average m. wt. about 70,000 |
| MA/AA (1) | Copolymer of 4:6 maleic/acrylic acid, average m. wt. about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula NaBO2.3H2 O.H2O2— |
| PB1 | Anhydrous sodium perborate bleach of nominal formula NaBO2.H 2O2 |
| Percarbonate | Sodium percarbonate of nominal formula 2Na2CO3.3H2O2 |
| NOBS | Nonanoyloxybenzene sulfonate in the form of the sodium salt |
| NAC-OBS | (6-nonamidocaproyl) oxybenzene sulfonate |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer sodium salt. |
| Photoactivated bleach | Sulfonated zinc phthlocyanine encapsulated in bleach (1) dextrin soluble polymer |
| Photoactivated bleach | Sulfonated alumino phthlocyanine encapsulated in bleach (2) dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrolidone polymer, with an average m. wt. of 60,000 |
| PVNO | Polyvinylpyridine N-oxide polymer, with an av. m. wt. of 50,000 |
| PVPVI | Copolymer of polyvinylpyrolidone and vinylimidazole, with an average molecular weight of 20,000 |
| QEA | bis((C2HSO)(C2H4O)n)(CH3) —N + —C6H12—N + —(CH3) bis((C2H5O)—(C2H4O))n, wherein n = from 20 to 30 |
| SRP 1 | Anionically end capped poly esters |
| SRP 2 | Diethoxylated poly (1, 2 propylene terephthalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |

-continued

| | |
|---|---|
| Opacifier | Water based monostyrene latex mixture, sold by BASF Aktiengesellschaft under the tradename Lytron 621 |
| Wax | Paraffin wax |
| HMEO | Hexamethylenediamine tetra(ethylene oxide)24 |

Example I

This Example illustrates a process according to this invention which produces uniform free flowing, good dispensing and dissolving detergent particles with uniformity of colour and particle shape. Multiple detergent starting ingredients are dry mixed in an orbital vertical screw mixer of 200 kg batch size, and several batches prepared. This premix is conveyed at 500 kg/hr into a horizontal plate fluidised bed drier with outlet weir to maintain a constant static bed depth of 20 cm. Fluidising inlet air at 120° C. is blown into the bed to maintain a fluidisation velocity of typically 2.0 ms-1. Fines are elutriated from the top of the bed, are collected in a hopper and recycled back to the bed. Air atomised spray nozzles are installed in the bed in a specific arrangement—typically 2 manifolds each with 3 nozzles aligned along the horizontal axis of the bed, positioned above the surface of the static bed. Binder is made by weighing PEG 4000 into an agitated hot water jacketed tank of water at 60° C., to create a 30% PEG solution. Binder is pumped to the spray nozzle at 100 kg/hr and atomised with 3 bar air within the fluid bed. Product is collected from the fluid bed and is screened on Mogensen vibratory screening units using three decks with 1250 μm, 710 μm and 425 μm screens installed. Oversize particles are ground and recycle to the fluid bed with the fines stream. Collected product (yield between the 1250 μm and 425 μm screens) is of density 445 g/L and mean particle size 570 μm. The sphericity index is 1.4 with a standard deviation of 0.4. The product has a high whiteness value of W=98.5. Other standard detergent materials are post dry-added to the product in a mixing drum—including enzymes, perfume and dyed carbonate speckles. Spray-on materials such as perfume or nonionic surfactant may also be added at this stage to make a fully formulated detergent product.

The finished detergent has the following composition

| Component | % Weight of Total Feed |
|---|---|
| Dry materials added to the premix | |
| Spray dried blown powder* | 76.6% |
| TAED as agglomerate | 4.2% |
| Silicone based antifoam as agglomerate | 4.0% |
| Sodium carbonate | 3.1% |
| Polymeric soil release agent | 0.5% |
| Na2Si2O5 layered silicate (SKS-6) | 5.8% |
| Binder, sprayed onto the premix in the fluid bed | |
| Polyethylene glycol (RMM = 4000) (delivered via a 30% active solution) | 5.7% |

*comprising of sodium linear alkyl benzene sulphonate (13.4 wt %), zeolite A (40%), sodium sulphate (23.5%), sodium carbonate (8.4%), magnesium sulphate (0.7 wt %), EDDS (0.4 wt %), MA/AA (2.5 wt %), soap (1.5 wt %), QAS 1(2.0 wt %), HEDP(0.3 wt %), optical brightener(0.5 wt %), water (5.3 wt %), diamine hexamethylene tetra (ethylene oxide) 24 (1.5 wt %).

Example II

This Example also illustrates the process of the invention and incorporates the parameters of Example I. A premix of dry detergent materials is prepared as in example 1, of composition as listed below. The mix is fed into a continuous Lodige KM 600 plough-share mixer, which is a horizontally-positioned moderate speed mixer, at 200 kg/hr feedrate. The rotational speed of the shaft in the mixer is about 100 rpm and the rotational speed of the cutters is about 3000 rpm. Water, at 60° C., is pumped from a hot water jacketed tank, as binder at 20 kg/hr. The water is atomised using air atomised nozzles positioned within the Lodige KM.

Product from the Lodige KM is fed continuously into a horizontal plate fluidised bed drier, which reduces the free moisture content to about 6% (Mettler infra-red oven method). Product is collected from the fluid bed and is screened on Mogensen vibratory screening units using three decks with 1180 μm, 710 μm and 500 μm screens installed. Oversize particles are ground and recycled to the fluid bed with the fines stream. Collected product (yield between the 1180 μm and 500 μm screens) is of density 620 g/L and mean particle size 610 μm. The sphericity index is 1.21 with a standard deviation 1.2 and a whiteness value W=97.0. Other standard detergent materials are post dry-added to the product in a mixing drum—including enzymes, perfume and dyed carbonate speckles. Spray-on materials such as perfume or nonionic surfactant may also be added at this stage to form a fully formulated detergent.

| Component | % Weight of Total Feed |
|---|---|
| Dry materials added to the premix | |
| Spray dried blown powder* | 70.4% |
| Na2Si2O5 layered silicate (SKS-6) | 12.7% |
| QAS 1 | 2.4% |
| TAED as agglomerate | 4.0% |
| Silicone based antifoam as agglomerate | 0.8% |
| sodium carbonate | 5.0% |
| sodium sulphate | 4.6% |
| Binder, sprayed onto the premix in the Lodige KM | |
| Water | 10.0% |
| Water removed in drying process | −10.0% |
| Brightener 15 | 0.1% |

*formulation as described in example 1 above.

Further Example Compositions

In the following examples all levels are quoted as % by weight of the composition:

TABLE

The following compositions are in accordance with the invention.

| | A | B | C | D | E | F | Geometric mean particle diameter (μm) | Span | ΔE Colour difference of raw material compared to finished composition | Sphericity index |
|---|---|---|---|---|---|---|---|---|---|---|
| 1. Spray-dried Granules | | | | | | | 450 μm | 1.8 | 2.4 | 1.9 |
| LAS | 4.0 | 5.0 | 11.0 | 7.0 | 4.0 | 5.0 | | | | |
| TAS | — | — | — | — | — | 1.0 | | | | |
| $C_{45}$AS | 1.0 | — | — | — | 1.0 | — | | | | |
| C16–C17 branched AS | 2.0 | 3.0 | — | — | 2.0 | — | | | | |
| DTPA, HEDP and/or EDDS | 0.5 | 0.6 | 0.5 | 0.7 | 1.0 | 0.5 | | | | |
| MgSO4 | 0.5 | 0.4 | 0.5 | 0.4 | 0.5 | 0.5 | | | | |
| Sodium carbonate | 10.0 | 7.0 | 8.0 | 8.0 | 3.0 | 10.0 | | | | |
| Sodium sulphate | 5.0 | 2.0 | 2.0 | 5.0 | 3.0 | 3.0 | | | | |
| Zeolite A | 18.0 | 20.0 | 18.0 | 10.0 | 20.0 | 17.0 | | | | |
| SKS-6 | — | — | — | — | — | — | | | | |
| MA/AA or AA | 1.0 | 1.5 | 1.0 | 0.6 | 1.0 | 0.6 | | | | |
| C8–C10 HEQ | 1.0 | 0.5 | 1.0 | — | 0.8 | 1.0 | | | | |
| Brightener | 0.1 | 0.05 | 0.05 | 0.06 | 0.05 | 0.05 | | | | |
| HMEO | 0.5 | 0.5 | 1.0 | 0.5 | 1.0 | 1.0 | | | | |
| Soap | — | 1.5 | 1.0 | 1.5 | — | 1.5 | | | | |
| 2. Components within the premix | | | | | | | | | | |
| Spray dried granules (1) | 50.0 | 50.0 | 48.0 | 40.0 | 40.0 | 50.0 | | | | |
| Nonionic AE7/AE5 | — | — | 5.0 | — | — | — | | | | |
| Sodium carbonate | 2.0 | 8.0 | — | 4.0 | 6.0 | 5.0 | 200 μm | 1.5 | 4.0 | 1.5 |
| Sodium sulphate | — | — | — | — | 2.0 | 1.0 | 350 μm | 1.6 | 3.5 | 1.5 |
| QAS 1 agglomerate | — | — | — | 2.0 | — | 1.0 | 500 μm | 2.7 | 5.0 | 2.1 |
| Nonionic agglomerate | | | | 10.0 | — | — | 500 μm | 1.9 | 8.3 | 1.8 |
| SKS-6/LAS agglomerate | — | — | — | 12.0 | — | — | 350 μm | 1.8 | 14.6 | 1.9 |
| Silicone antifoam agglomerate | 2.5 | 2.5 | 2.0 | 0.5 | — | 2.5 | 500 μm | 2.0 | 14.3 | 1.5 |
| SRP 1 | 0.5 | — | — | — | 0.5 | 0.3 | 500 μm | 2.0 | 10.4 | 2.0 |
| TAED agglomerate | 2.5 | 2.5 | 3.0 | — | — | — | 550 μm | 1.5 | 11.4 | 1.6 |
| SKS-6 powder | 3.5 | 3.5 | 9.0 | — | 3.5 | 5.0 | 60 μm | 1.9 | 6.0 | 1.7 |
| TAED powder | — | — | — | — | 1.5 | 2.0 | 80 μm | 1.7 | 9.5 | 1.6 |
| 3. Premix binder applied to the premix (2) | | | | | | | | | | |
| PEG 4000 | 5.0 | | | | | | | | | |
| PEG 1500 | | | | 6.0 | | | | | | |
| AS, LAS, branched AS | | | | | 5.0 | 6.0 | | | | |
| Water as binder (removed on drying) | | 10.0 | 15.0 | | | | | | | |
| Other additives post-added to make the final detergent formulation: | | | | | | | | | | |
| 4. Spray-on materials | | | | | | | | | | |
| Perfume | 0.4 | 0.2 | 0.4 | 0.4 | 0.5 | 0.3 | | | | |
| 5. Dry-added materials | | | | | | | | | | |
| Premix (2) | 70.0 | 65.0 | 55.0 | 65.0 | 70.0 | 60.0 | | | | |
| Enzymes (protease, lipolase, amylase, cellulase) | 2.0 | 1.5 | 1.0 | 1.3 | 1.2 | 1.5 | | | | |

TABLE-continued

The following compositions are in accordance with the invention.

| | A | B | C | D | E | F | Geometric mean particle diameter (μm) | Span | ΔE Colour difference of raw material compared to finished composition | Sphericity index |
|---|---|---|---|---|---|---|---|---|---|---|
| NACAOBS | 3.0 | 2.5 | 3.0 | 3.5 | 3.5 | 2.5 | | | | |
| Sodium percarbonate | 13.0 | 10.0 | 10.0 | 12.0 | 12.0 | 10.0 | | | | |
| Photobleach | 0.02 | 0.02 | 0.02 | 0.02 | 0.02 | 0.02 | | | | |
| Perfume encapsulates | 0.7 | 0.5 | 0.6 | 0.8 | 0.9 | 0.4 | | | | |
| Citric acid | 6.0 | 4.0 | 2.0 | 4.0 | 6.5 | 5.0 | | | | |
| Sodium carbonate speckle | 1.0 | 1.0 | 1.0 | 0.5 | 1.5 | 1.5 | | | | |
| Zeolite A | 0.1 | — | — | 0.3 | — | — | | | | |
| TAED agglomerate | — | — | — | 3.0 | — | — | | | | |
| Silicone antifoam agglomerate | — | — | — | — | 3.0 | — | | | | |
| 6. Coating Applied to premix (2) | | | | | | | | | | |
| Burkeite (applied from 30 wt % aqueous solution) | 4.0 | 5.0 | 8.0 | — | 5.0 | — | | | | |
| Brightener 15 | 0.1 | 0.1 | — | — | — | — | | | | |
| Fillers up to 100% | | | | | | | | | | |
| Finished product | | | | | | | | | | |
| Median particle size | 600 μm | 600 μm | 600 μm | 800 μm | 800 μm | 600 μm | | | | |
| Span (geometric standard deviation) | 1.4 | 1.2 | 1.4 | 1.2 | 1.4 | 1.6 | | | | |
| Sphericity index | 1.30 | 1.20 | 1.35 | 1.40 | 1.45 | 1.40 | | | | |
| Whiteness W = L-3b | 98.0 | 96.5 | 98.5 | 92.0 | 97.0 | 101.5 | | | | |

What is claimed is:

1. A detergent particle comprising at least two particulate components, a first component of a first color and a second component of a second color, the first and second components being adhered to one another, the geometric mean particle diameter of at least one of the first or second particulate component being no more than 50% of the geometric mean particle diameter of the detergent particle and wherein the detergent particle has a sphericity index no greater than 1.7 and at least on of the first and second components has a sphericity index greater than 1.7.

2. A detergent particle according to claim 1 in which the color difference (ΔE) between the first and second particulate components as measured using tri-stimulus colorimetry Colorimeter is at least 3, where $\Delta E=\sqrt{(\Delta L^2+\Delta a^2+\Delta b^2)}$, where ΔL is the difference in L value between the first and second particulate components, Δa is the difference in a value between the first and second particulate components and Δb is the difference in b value between the first and second particulate components.

3. A detergent particle according to claim 2 in which the color difference (ΔE) between the first and second particulate components is at least 5.

4. A detergent particle according to claim 1 in which the first particulate component has a geometric mean particle diameter greater than 150 microns.

5. A detergent particle according to claim 1 in which both the first and second particulate components have a geometric mean particle diameter greater than 150 microns.

6. A detergent particle according to claim 1 having a sphericity index no greater than 1.5.

7. A detergent particle according to claim 1 in which the sphericity index of at least the first or second component is greater than 2.

8. A detergent particle having a geometric mean particle diameter greater than 500 microns, the detergent particle comprising a first particulate component and a second particulate component, the first and second particulate components being adhered to one another substantially in the absence of pressure compaction, the geometric mean particle size of at least one of the first and second components being no more than 50% of the geometric mean particle size of the detergent particle and at least one of the first and second particulate components having a span of at least 2.

9. A detergent particulate according to claim 8 in which at least one of the first and second particulate components has a span at least 3.

10. A detergent particle according to claim 8 in which at least one of the first and second particulate components has a geometric mean particle diameter no more than 25% of the geometric mean particle size of the detergent particle.

11. A detergent particle according to claim 8 having a span less than 1.8.

12. A detergent particle according to claim 8 in which at least the first particulate component has a geometric mean particle diameter from 200–500 microns.

13. A detergent particle according to claim 8 having a geometric mean particle diameter from 500–2500 microns.

14. A detergent particle according to claim 8 in which there is a difference in geometric mean particle diameter between the first and second particulate components of at least 250 microns.

15. A method for making a detergent particle according to claim 1 comprising contacting the first particulate component and the second particulate component, optionally in the presence of a binder in a moderate to low shear mixing step to adhere the first and second particulate components to one another.

16. A method according to claim 15 in which the mixing step is a low shear mixing step which takes place in a pan granulator, drum mixer, rotating bowl mixer or fluidised bed.

17. A method according to claim 15 in which the mixing step is a moderate shear mixing step which takes place in a ploughshare mixer having a tip speed for the ploughs of below 10 m/s.

18. A method according to claim 15 in which a binder is added during or immediately preceding the mixing step.

19. A detergent composition comprising detergent particles according to claim 1.

* * * * *